United States Patent [19]

Zwick et al.

[11] Patent Number: 4,860,545

[45] Date of Patent: Aug. 29, 1989

[54] CRYOGENIC STORAGE TANK WITH A RETROFITTED IN-TANK CRYOGENIC PUMP

[75] Inventors: Eugene B. Zwick; William D. Brigham, both of Huntington Beach, Calif.

[73] Assignee: Zwick Energy Research Organization, Inc., Huntington Beach, Calif.

[21] Appl. No.: 268,193

[22] Filed: Nov. 7, 1988

[51] Int. Cl.[4] ..... F17C 13/00

[52] U.S. Cl. ..... 62/50.6; 222/383; 417/901

[58] Field of Search ..... 62/55; 222/383; 417/901

[56] References Cited

U.S. PATENT DOCUMENTS

| | | | |
|---|---|---|---|
| 2,888,879 | 6/1959 | Gaarder | 62/55 |
| 2,932,310 | 4/1960 | Koblish | 62/55 |
| 3,109,293 | 11/1963 | Williams et al. | 62/55 |
| 3,212,280 | 10/1965 | Thomas et al. | 62/55 |
| 3,220,202 | 11/1965 | Gottzman | 62/55 |
| 3,276,214 | 10/1966 | Wilson et al. | 62/49 |
| 3,431,744 | 3/1969 | Veilex et al. | 62/55 |
| 4,418,544 | 12/1983 | Heybutski et al. | 62/55 |
| 4,472,946 | 9/1984 | Zwick | 62/55 |
| 4,593,835 | 6/1986 | Kikkawa et al. | 62/55 |

*Primary Examiner*—Ronald C. Capossela
*Attorney, Agent, or Firm*—Vernon D. Beehler; William H. Pavitt, Jr.; Ralf H. Siegemund

[57] ABSTRACT

A removable pump assembly for use in a cryogenic storage tank pumps liquid cryogen directly from the primary storage container with low boiloff loss. The cryogenic storage tank has an outer vessel, an inner vessel, an evacuated insulation space therebetween and a access port connecting the inner and outer vessels and providing an open cylindrical access to the interior of the cryogenic tank. A pump mounting tube assembly is disposed into the interior of the inner vessel of the cryogenic tank through the access port and includes an inner pump mounting tube and an outer pump mounting tube which are joined at their upper and lower rims to define an insulating jacket between the two tubes. The inner and outer pump mounting tubes are affixed at their upper ends to a top and bottom plate. The top and bottom plate in turn is affixed to an insulating block. Only the insulating block, which is disposed in the access port of the cryogenic tube, is in contact with any portion of the cryogenic tank. The insulating block provides a poor thermal path and also provides a gas seal between the pump mounting tube and the access port of the cryogenic tank. The pump mounting tube thus defines a long heat path into the cryogenic tank and is insulated from the liquid cryogen by a pocket of trapped gas formed within the inner tube by heating cryogen. A pump is introduced through the inner pump mounting tube and is also insulated against contact with liquid cryogen by the trapped gas. Only the lowermost end of the pump is immersed in cryogen, thereby minimizing heat conduction into the cryogen within the tank.

14 Claims, 2 Drawing Sheets

CRYOGENIC STORAGE TANK WITH A RETROFITTED IN-TANK CRYOGENIC PUMP

BACKGROUND OF THE INVENTION

1. Field of the Invention

The present invention relates to the field of cryogenic storage containers and in particular to a cryogenic tank which is retrofitted to receive an in-tank submerged pump for pumping the cryogen directly out of the primary storage tank with a minimum of heat leakage into the cryogenic tank.

2. Description of the Prior Art

A cryogenic fluid or cryogen such as liquid nitrogen is a substance which exists in the liquid state only at very low temperatures and consequently has a very low boiling point. Because of this low boiling point, two primary considerations when designing a system for storing and pumping a cryogen are the need for adequate insulation of the storage container to minimize losses of cryogen due to "boiloff", and the need to cool down the pump to the cryogen temperature before pumping.

In order to meet the first criterion, cryogenic tanks rely on good thermal and/or radiation barriers, i.e., insulation, high vacuums between container walls, and construction techniques which minimize the thermal leak paths from the exterior environment into the cryogen. Typical thermal paths in cryogenic storage systems include conduction, convection and radiation between the inner and outer shells, fluid and gas lines which connect the inner shell to the outside, supports for the inner shell of a multi-shell container, and any connection to pumps for pumping the cryogen from the primary storage tank. Due to its mass and its inevitable contact with the cryogen, a pump normally provides a high thermal leak path which in existing systems has lead to unacceptably high losses of cryogen due to boiloff.

The solution to this problem generally adopted in the past has been to locate the pump outside the primary cryogenic storage tank where the pump is normally kept at ambient temperature. However, in order to keep the cryogen in the liquid state while being pumped, the pump must be cooled down to the cryogen temperature before pumping can begin. This therefore introduces a delay in system start-up, as it usually takes at least five to ten minutes to cool down the pump sufficiently. When an auxiliary sump is used, the sump must also be cooled down in order to prepare the system for a pumping operation. Cooling down the pump and sump is wasteful of cryogen since a quantity of the liquid is lost in the cool-down procedure by boiloff. In situations where a start-up delay is unacceptable, the pump must be kept in a standby condition in readiness for immediate operation. The pump must therefore be kept in a cooled-down state by being submerged in the cryogen, either in the primary storage tank or in an auxiliary sump, and high rates of boiloff must be tolerated. The use of auxiliary sumps is common because the heat leak through the pump into the sump is isolated from the main storage tank, and the loss of cryogen can be reduced when standby is not required by shutting off the pump/sump from the main storage tank. Nevertheless, the use of sumps represents a compromise which increases the cost and complexity of cryogenic storage systems.

The assignee of the present invention has solved these problems by devising a design for a built-in submerged pump which can be kept in a continuously cooled-down state in readiness for immediate operation, without excessive losses of cryogen by boiloff due to heat leakage through the pump into the interior of the primary storage container. See, for example, Zwick, "*Cryogenic Storage Tank with a Built-in Pump*", U.S. Pat. No. 4,472,946, which is expressly incorporated herein by reference.

However, the advantages of the Zwick design are achieved in large part by the design integration of the built-in submerged pump in the cryogenic tank. The cryogenic tank and the built-in pump are thus made as a single design unit, each with features which serve in combination to achieve the objects as a whole. Thus, it cannot be expected that preexisting cryogenic tanks can be utilized in any meaningful way to obtain the advantages of the Zwick design.

Therefore, what is needed is an improvement which allows many or all of the advantages of a cryogenic tank with an integrally built-in design submerged pump to also be achieved in a retrofitted conventionally designed cryogenic tank.

BRIEF SUMMARY OF THE INVENTION

The invention is a low boiloff submersible pump assembly for use in a conventional cryogenic tank having an open access port comprising a pump, and a removable pump mounting tube extending through the access port of the cryogenic tank. The access port connects the inner and outer vessels comprising the cryogenic tank. The pump mounting tube has an inner surface thermally insulated from an outer surface of the tube and from the access port of the cryogenic tank. The tube has an open lower end. The upper end of the tube includes an element adapted to make a gas-tight seal with the pump mounted thereto. The tube extends through the tank and into the cryogen stored in the tank.

The pump assembly further comprises a cryogenic pump extending into the tank through the interior of the pump mounting tube. The pump includes a pump drive head mounted to the upper end of the pump mounting tube. The drive head is also thermally insulated from the outer surface of the pump mounting tube and vessel walls in contact with cryogen stored therein. The pump drive head makes a gas-tight seal with the upper end of the pump mounting tube and traps a pocket of vaporized cryogen within the tube and prevents liquid cryogen from rising into the pump mounting tube.

The pump assembly further comprises a pump extension tube extending into the tank from the drive head and spaced from the inner surface of the pump mounting tube.

The invention is also characterized as a cryogenic pump assembly for use in a conventional cryogenic storage tank characterized by an outer vessel, an inner vessel, an insulation space therebetween and an access port connecting the inner and outer vessels. The pump assembly comprises an insulating block to form a gas seal with the access port. An outer tube within the inner vessel is connected at its upper end to the insulating block. An inner tube within the outer tube is also connected at its upper end to the insulating block. The outer and inner tubes are joined at their lower and upper rims to define an annular evacuated space between the inner and outer tubes.

The pump assembly further comprises a pump drive head mounted to the inner tube to make a gas-tight seal. A pump extension tube is disposed through the inner tube and a pump intake assembly is supported by the extension tube within the inner vessel.

The cryogenic pump is provided with a mounting element including an element for sealing the upper end of the pump mounting tube.

The invention is still further characterized as a removable pump assembly for use in a conventional cryogenic storage tank including an insulated vessel with an access port. The pump assembly comprises a pump mounting tube extending vertically through the access port and having an open lower end. The pump mounting tube has an inner and outer surface thermally insulated from the wall in contact with cryogen stored in the vessel, and a cryogenic pump extending into the vessel through the pump mounting tube. The pump has a cryogen intake disposed below the lower end of the mounting tube. The pump mounting tube is closed at its upper end so as to contain a pocket of vaporized cryogen in its interior.

The pump mounting tube is closed at its upper end by an insulating block. The insulated vessel comprising the cryogenic storage tank contacts only the insulated block.

The pump mounting tube includes a top and bottom plate. The inner and outer surface of the pump mounting tube is mechanically and thermally coupled only to the top and bottom plate. The top and bottom plate is connected to the insulating block.

The insulating block provides a gas seal between the access port of the insulated vessel and the pump mounting tube.

The pump mounting tube is closed at its upper end above the insulating block.

The invention may be better visualized by considering the following drawings wherein like elements are referenced by like numerals.

Turn now to the following description wherein the illustrated embodiment is discussed in detail.

DETAILED DESCRIPTION OF THE PREFERRED EMBODIMENTS

A removable pump assembly for use in a cryogenic storage tank pumps liquid cryogen directly from the primary storage container with low boiloff loss. The cryogenic storage tank has an outer vessel, an inner vessel, an evacuated insulation space therebetween and an access port connecting the inner and outer vessels and providing an open cylindrical access to the interior of the cryogenic tank. A pump mounting tube assembly is disposed into the interior of the inner vessel of the cryogenic tank through the access port and includes an inner pump mounting tube and an outer pump mounting tube which are joined at their upper and lower rims to define an insulating jacket between the two tubes. The inner and outer pump mounting tubes are affixed at their upper ends to a bottom and top plate respectively. The top and bottom plates in turn are affixed to an insulating block. Only the insulating block, which is disposed in the access port of the cryogenic tube, is in contact with any portion of the cryogenic tank. The insulating block provides a poor thermal path and also provides a gas seal between the pump mounting tube and the access port of the cryogenic tank. The pump mounting tube thus defines a long heat path into the cryogenic tank and is insulated from the liquid cryogen by a pocket of trapped gas formed within the inner tube by heated cryogen. A pump is introduced through the inner pump mounting tube and is also insulated against contact with liquid cryogen by the trapped gas. Only the lowermost end of the pump is immersed in cryogen, thereby minimizing heat conduction into the cryogen within the tank.

Figure 1:
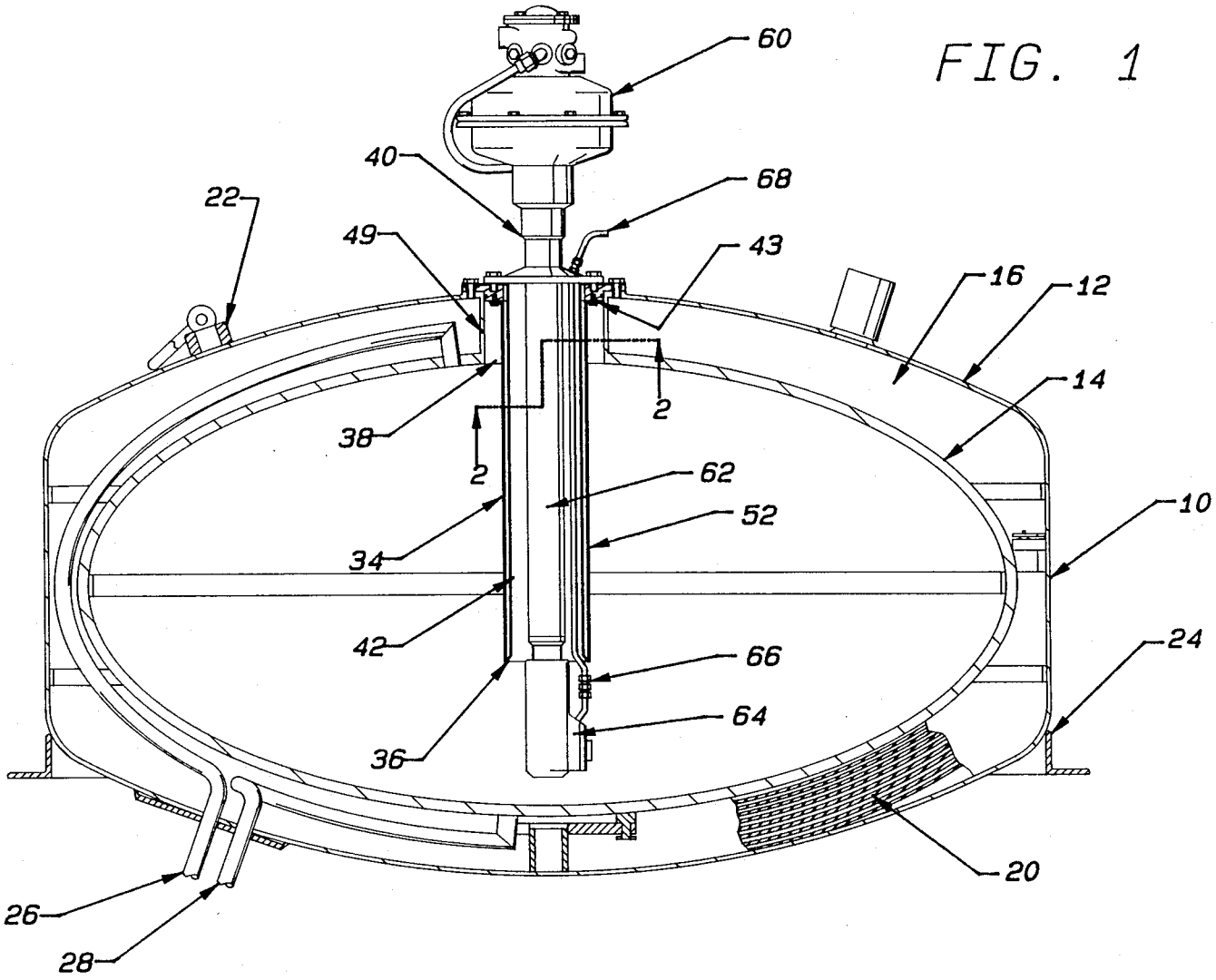
FIG. 1 is a cross-sectional view of a conventional cryogenic tank with a retrofitted submerged pump according to the invention.

With reference to FIG. 1, a cryogenic tank 10 includes an outer vessel 12 which encloses an inner vessel 14. The outer vessel wall is spaced from the inner vessel wall to define an insulation space 16 surrounding the inner vessel. The insulation space is evacuated to create a vacuum or near-vacuum in the space 16 and thereby minimize heat flow into the inner vessel by conduction or convection. The insulation space also contains means for minimizing heat transfer by radiation from the outer vessel into the inner vessel. These means may commonly employ either a powder such a pearlite, or layers of reflective material. In one form of multiplayer insulation the inner vessel is also wrapped in or coated with a reflecting material, such as aluminumized Mylar TM, which prevents the transfer of thermal energy by radiation. The radiation barrier may consist of a multi-layered blanket 20 comprised of forty sheets of one fourth ($\frac{1}{4}$) mil aluminumized mylar which has been crinkled so that adjacent sheets are spaced from each other by the irregular ridges of the crinkled surfaces. The crinkling reduces the area of contact between sheets and establishes relatively long heat flow paths through the multilayer blanket, thus minimizing conduction of heat through the mylar material. While only a fragment of the insulating blanket 20 is illustrated in FIG. 1, it will be understood that the entire inner tank is covered by such a blanket within the insulation space 16.

A pump mounting tube 34 extends vertically through the top of both the outer vessel 12 and inner vessel 14 and is aligned with the vertical axis of the tank assembly. The pump mounting tube 34 is open at its lower end 36 to the interior of the inner vessel 14 and is also open at its upper end 38 for admitting a pump extension tube/drive shaft 62.

Figure 2:
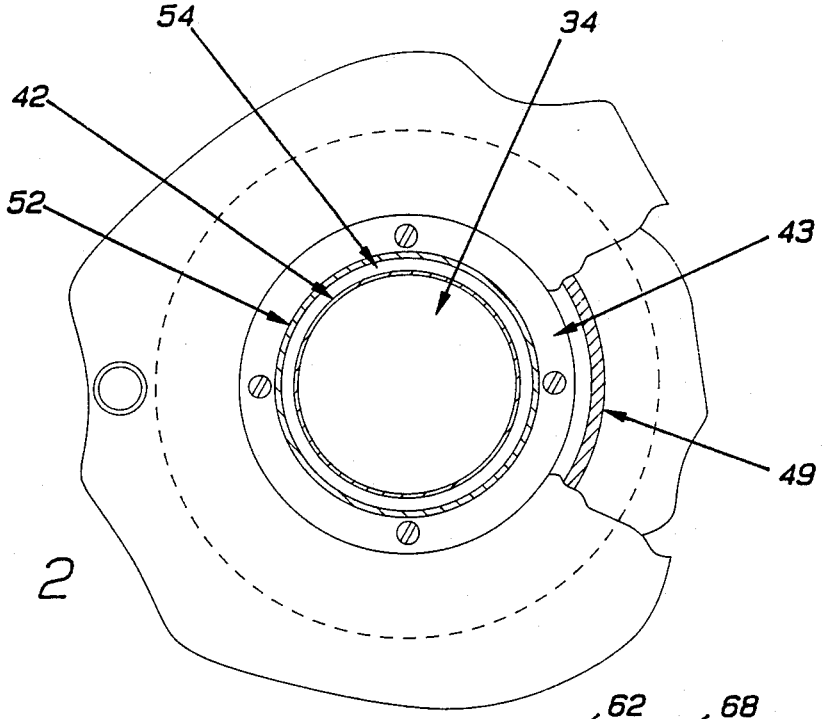
FIG. 2 is a cross-sectional view taken through lines 2—2 of FIG. 1.
Figure 3:
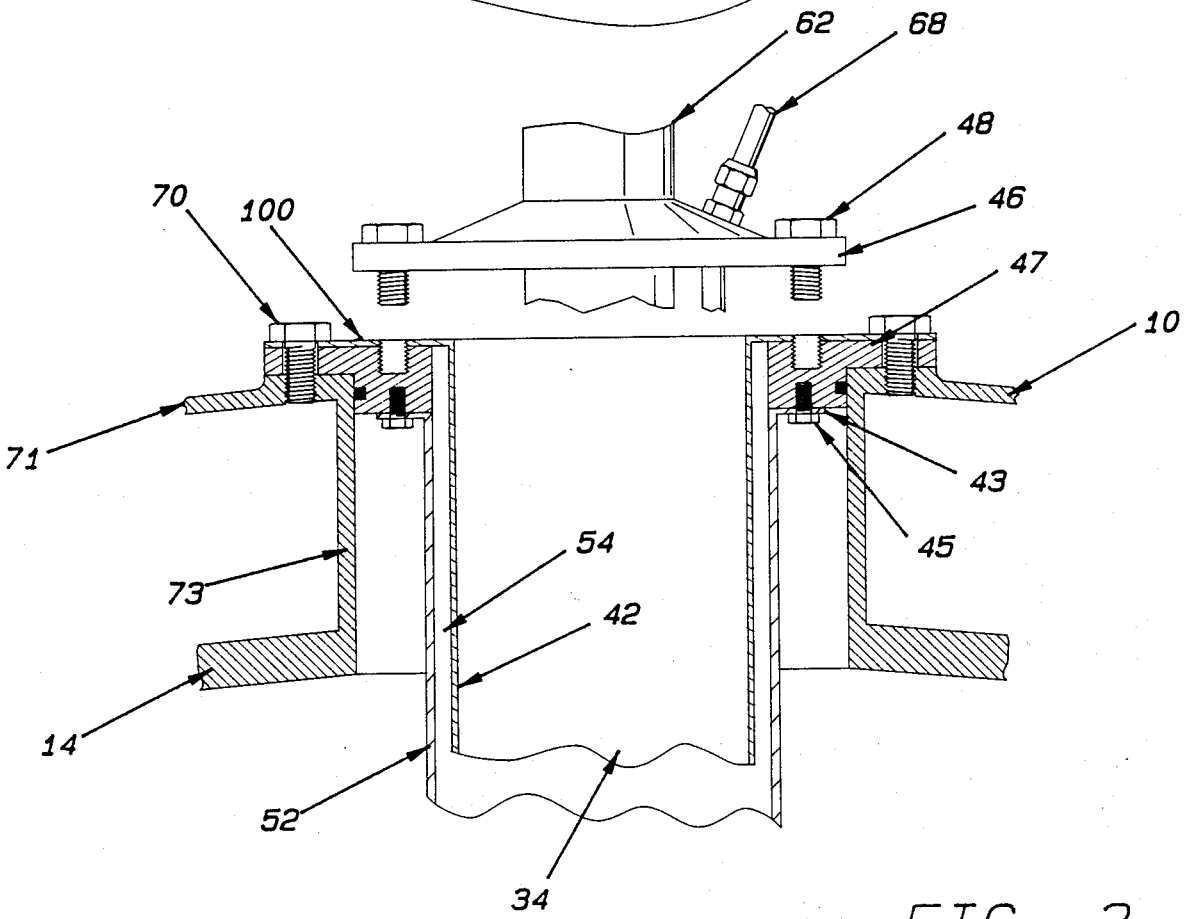
FIG. 3 is a longitudinal cross-sectional view of the attachment of the submerged pump and through the access port of the cryogenic tank.

As better understood by reference to FIGS. 2 and 3, pump mounting tube 34 is double-walled and provides an inner tube 42 and an outer tube 52. Inner pump tube 42 is attached at its upper end to a top plate 100 by welding. Inner tube 42 is attached to top plate 100. Outer tube 52 is attached to bottom plate 43. Bottom plate 43 and top plate 100 are separated by phenolic spacer 46. Both top plate 100 and bottom plate 43 in turn are bolted by means of bolts 45 to an insulative or phenolic spacer 46. The pump mounting flange 47 is provided with a number of mounting bolts 48 which thread into corresponding bores 49 in the flange 47.

The lower ends of inner tube 42 and outer tube 52 are joined and an air-tight seal 36 shown in FIG. 1 as achieved, e.g., by welding together the lower rims of the coaxial tubes 42 and 52. The inside diameter of the outer tube 52 is somewhat greater than the outside diameter of the inner tube 42 and defines a jacket space 54 between the two tubes. This jacket space is evacuated. Jacket space 54 is evacuated during manufacture of mounting tube 34 by conventional means although provisions may be made for reevacuation during use.

The upper end of the inner tube 42 is in thermal contact only with plate 100 and mounting flange 47 and a temperature gradient is therefore established along the inner tube which ranges from close to ambient temperature near plate 100 at the top of the tube down to the boiling point of the cryogen at the lower end 36 of the pump mounting tube 34.

Bottom plate 43 is spaced from access port 49 of cryogenic tank 10 so that the only portion of the pump assembly which contacts the cryogenic tank or its access port 49 is phenolic mounting flange 47. Additional O-rings or other sealing means may be provided within phenolic mounting flange 47 as desired to insure a gas-tight or nearly gas-tight connection between the pump assembly and the cryogenic tank.

Although the upper end of inner tube 42 will be near ambient temperature because of the heat being conducted through the core of the pump assembly, there will be no direct thermal contact to any portion of tube 52 from the external environment other than through the highly thermally resistive conductive path through thickened phenolic flange 47. Mounting flange 47 is connected to tank 10 by means of mounting bolts 70 which thread into coreesponding bores 72 in flange 71. Flange 71 is attached to tank 10 at the neck 73 and at outer shell 12.

However, the pump assembly, as shown in the Figures, can be easily manually inserted within a preexisting conventional cryogenic tank, left submerged while utilizing the tank and then removed and placed in another cryogenic tank without the need for a permanent, dedicated or built-in installation into the cryogenic tank. Nevertheless, substantially all of the advantages which were previously obtained in connection with the integrally designed and built-in submerged tank described in U.S. Pat. No. 4,472,946 are also achieved by the presently described retrofitted version.

The cryogenic pump includes a pump drive head 60 shown in FIG. 1 which is external to the cryogenic tank and thus readily accessible for repair or maintenance. A pump extension tube 62 extends downwardly from the drive head 60 and supports at its lower end a pump piston and intake valve unit 64. The pump piston is reciprocated by a drive shaft enclosed in the extension tube 62 and is not visible in the drawing. The length of the pump extension tube 62 is such that the pump piston and intake valve unit 64 are suspended near the bottom of the inner vessel 14 so as to draw in the cryogen from the bottom of the vessel. A pump output tube 66 extends upwardly from the cryogen intake unit 64 through the inner pump mounting tube 42 adjacent to the pump extension tube 62, passes through the pump mounting flange 46 and terminates in an external cryogen discharge port 68 which delivers the cryogen output of the pump 40.

When the inner vessel 14 of the cryogenic tank is initially filled with cryogen, the liquid tends to rise into the inner tube 42. However, as was earlier explained, the top of this tube is relatively warm so that some of the cryogen within the pump mounting tube vaporizes. The upper end of the tube 42 is sealed by the pump flange 46 so that a pocket of trapped gas is formed in tube 42. An equilibrium condition will be reached in which the entire interior of the pump mounting tube is filled with a pocket of gas which prevents additional cryogen from entering the tube. As a result, a gas/liquid interface is established near the lower end 36 of the pump mounting tube 34. The gas within the pump mounting tube is a poor conductor of heat and thus serves to effectively insulate the cryogen at the bottom of the pump mounting tube. The inner tube 42 is insulated from the liquid cryogen filling the vessel 14 by means of the vacuum jacket 54 defined by the outer tube 52 in order to prevent cooling of the inner tube 42 along its entire length. Such cooling would occur if the inner tube 42 were immersed directly in cryogen and would sufficiently lower the temperature of the inner surface of the inner tube 42 to cause condensation of the trapped gas. This would reduce the volume of the gas pocket and allow liquid cryogen to rise into the pump mounting tube 34, thereby shortening the length of the thermal path established by the inner tube 42 as well as increasing the area of the cryogenic pump in direct contact with the liquid cryogen. The pump mounting tube 34 also serves to insulate the pump extension tube 62 against contact with the liquid cryogen since the portion of the pump extension tube within the pump mounting tube extends through the trapped gas pocket. Only the lowermost portion 64 of the cryogenic pump is actually in contact with the cryogen.

The length of the pump mounting tube 34 is made as long as possible in order to extend the thermal path established by the inner pump mounting tube 42. The wall of tubes 42 and 52 are made as thin as possible, e.g., of 0.065 inch stainless steel tubing, in order to minimize the cross section of the thermal path established by the inner pump mounting tube and minimize conduction of heat to the lower end 36 of the pump mounting tube. The inner surface of tube 52 and the outer surface of tube 42 are desirably highly polished in order to improve the thermal insulation characteristics of the vacuum jacket defined between the two tubes.

The thickness of the tubing used for the pump extension tube 62 and drive shaft is also kept to a minimum so as to minimize the cross section of thermal path established thereby. Very thin materials can be used for the pump extension tube since it is in tension and supports only the relatively small weight of the piston and intake unit 64.

The pump drive head 60 may be of the gas driven type known in the art which may be driven by the boiloff gases of the cryogenic storage tank itself through suitable conduits.

The outer tank 12 can be further provided with one or more lifting rings 22 affixed to the upper surface of the outer tank. A circular base flange 24 is welded about the lower end of the outer tank 12. The flange 24 supports the tank 12 when it is mounted on a platform and the cryogenic tank is supported above or within the opening in the base. The insulated tank 10 can be further provided with a gas phase fill tube 26 and a liquid phase fill tube 28 connected to the top and bottom respectively of the inner tank 14 and extending through the insulation space 16 to the exterior of the cryogenic tank. The tank is further provided with suitable instruments and full trycock tubes and other conduits leading into the inner vessel 14 as may be needed and are known in the art.

It must be understood that many alterations and modifications can be made by those having ordinary skill in the art to the structure of the present invention without departing from the spirit and scope of the invention. Therefore, the presently illustrated embodiment has been shown only by way of example and for the purpose of clarity and should not be taken to limit the scope of the following claims.

We claim:

1. A low boiloff submersible pump assembly for use in a conventional cryogenic tank having an open access port comprising:

a pump;

a removable pump mounting tube extending through said access port of said cryogenic tank, said pump mounting tube having an inner surface thermally insulated from an outer surface of the tube and thermally insulated from said access port of said cryogenic tank, said tube having an open lower end, the upper end of said tube including means adapted to make a gas-tight seal with said pump mounted thereto, said tube extending through said tank and into said cryogen stored in said tank; and block means for thermally insulating said removable pump mounting tube from said cryogenic tank at said access port of said cryogenic tank, said mounting tube contacting said tank only at said access port through said block means.

2. The pump assembly of claim 1 further comprising a cryogenic pump extending into said tank through the interior of said pump mounting tube, said pump including a pump drive head mounted to the upper end of the pump mounting tube, said drive head also being thermally insulated from the outer surface of said pump mounting tube and vessel walls in contact with cryogen stored therein, said pump drive head making a gas-tight seal with the upper end of said pump mounting tube so as to trap a pocket of vaporized cryogen within said tube and prevent liquid cryogen from rising into the pump mounting tube.

3. The pump assembly of claim 1 wherein said pump further comprises a pump extension tube extending into said tank from said drive head and spaced from the inner surface of said pump mounting tube.

4. A cryogenic pump assembly for use in a conventional cryogenic storage tank characterized by an outer vessel, an inner vessel, and insulation space therebetween and an access port connecting said inner and outer vessels, said pump assembly comprising an insulating block to form a gas seal with said access port, an outer tube within said inner vessel connected at its upper end to said insulating block, an inner tube within said outer tube connected at its upper end to said insulating block, said outer and inner tubes being joined to said insulating block at their upper rims and to each other at their lower rims to define an annular evacuated space between said inner and outer tubes.

5. The pump assembly of claim 4 further comprising a pump drive head mounted to said inner tube to make a gas-tight seal, a pump extension tube through said inner tube and a pump intake assembly supported by said extension tube within said inner vessel.

6. The pump assembly of claim 5 wherein said cryogenic pump is provided with mounting means including means for sealing the upper end of said pump mounting tube.

7. A removable pump assembly for use in a conventional cryogenic storage tank including an insulated vessel with a access port, said pump assembly comprising a pump mounting tube extending vertically through said access port and having an open lower end, said pump mounting tube having an inner and outer surface thermally insulated from the wall in contact with cryogen stored in said vessel, and a cryogenic pump extending into said vessel through said pump mounting tube, said pump having a cryogen intake disposed below said lower end of the mounting tube, said pump mounting tube being closed at its upper end so as to contain a pocket of vaporized cryogen in its interior, further comprising an insulating block wherein said pump mounting tube is closed at its upper end by said insulating block, said insulated vessel comprising said cryogenic storage tank contacting only said insulated block.

8. The pump assembly of claim 7 wherein said pump mounting tube comprises a top plate and a bottom plate, said inner and outer surface of said pump mounting tube mechanically and thermally coupled only to said top and bottom plates, said top and bottom plates being connected to said insulating block.

9. The pump assembly of claim 7 wherein said insulating block provides a gas seal between said access port of said insulated vessel and said pump mounting tube.

10. The pump assembly of claim 7 wherein said insulating block provides a gas seal between said access port of said insulated vessel and said pump mounting tube.

11. The pump assembly of claim 8 wherein said pump mounting tube is closed at its upper end above said insulating block.

12. The pump assembly of claim 8 wherein said pump mounting tube is closed at its upper end above said insulating block.

13. The pump assembly of claim 10 wherein said pump mounting tube is closed at its upper end above said insulating block.

14. The pump assembly of claim 7 wherein said pump mounting tube comprises a top and bottom plate, said inner and outer surface of said pump mounting tube mechanically and thermally coupled only to said top and bottom plate, said top and bottom plate being connected to said insulating block.

* * * * *